US011577872B2

(12) United States Patent
Zhang

(10) Patent No.: US 11,577,872 B2
(45) Date of Patent: Feb. 14, 2023

(54) CORE OF HIGH-EFFICIENCY AND HIGH-SPEED CARTON SEALER AND METHOD FOR USING THE SAME

(71) Applicant: SUZHOU QUANXIN MACHINERY FITTING CO., LTD, Jaingsu (CN)

(72) Inventor: QiCang Zhang, SuZhou (CN)

(73) Assignee: SUZHOU QUANXIN MACHINERY FITTING CO., LTD, Jiangsu (CN)

( * ) Notice: Subject to any disclaimer, the term of this patent is extended or adjusted under 35 U.S.C. 154(b) by 65 days.

(21) Appl. No.: 17/251,707

(22) PCT Filed: Jun. 28, 2018

(86) PCT No.: PCT/CN2018/093486
§ 371 (c)(1),
(2) Date: Dec. 11, 2020

(87) PCT Pub. No.: WO2019/237435
PCT Pub. Date: Dec. 19, 2019

(65) Prior Publication Data

US 2021/0139177 A1 May 13, 2021

(30) Foreign Application Priority Data

Jun. 13, 2018 (CN) ..... 201810610236.5

(51) Int. Cl.
*B65B 51/06* (2006.01)
*B65H 35/00* (2006.01)
*B65B 59/00* (2006.01)

(52) U.S. Cl.
CPC ..... *B65B 51/067* (2013.01); *B65H 35/0033* (2013.01); *B65B 59/003* (2019.05); *B65H 2701/37* (2013.01)

(58) Field of Classification Search
CPC ..... B65B 51/06; B65B 51/067; B65B 59/003; B65H 35/0033; B65H 2701/37
(Continued)

(56) References Cited

U.S. PATENT DOCUMENTS 4,592,188 A * 6/1986 Marchetti ..... B65B 51/067 156/468
4,642,157 A * 2/1987 Cavanagh ..... B65H 16/04 156/530
(Continued)

FOREIGN PATENT DOCUMENTS

CN 201023693 Y 2/2008
CN 101804924 A 8/2010
(Continued)

OTHER PUBLICATIONS

Zhang Qicang, Structure Device for solving wrinkling of adhesive tape during box sealing of box sealing machine, and use method thereof (Year: 2015).*

*Primary Examiner* — Anna K Kinsaul
*Assistant Examiner* — Luis G Del Valle
(74) *Attorney, Agent, or Firm* — Muncy, Geissler, Olds & Lowe, P.C.

(57) ABSTRACT

A key component of a high-efficiency and high-speed carton sealer, i.e., a core, and the high-speed carton sealer is an important device for a high-speed packaging production line. The design of the core uses the second cylinder to control a return spring and a limit spring with one end freely set and the other end adjustable, which successfully solves the problems of the damage to the carton caused by its high-speed moving carton impacting the front wheel and rear wheel recovery speed not promptly enough to wipe the
(Continued)

tape on the back of the carton, and it is also possible to use a soft carton. Accordingly, the core of the high-speed carton sealer is realized.

4 Claims, 5 Drawing Sheets

(58) Field of Classification Search
USPC ..... 53/136.4
See application file for complete search history.

(56) References Cited

U.S. PATENT DOCUMENTS

| | | | | | |
|---|---|---|---|---|---|
| 5,507,907 | A * | 4/1996 | Kropp | B65H 35/0013 | 156/352 |
| 2002/0063698 | A1* | 5/2002 | Koike | B65C 9/46 | 345/173 |
| 2009/0217621 | A1* | 9/2009 | Fox | B65B 51/067 | 74/480 R |
| 2019/0352121 | A1* | 11/2019 | Lam | B65H 35/0033 | |

FOREIGN PATENT DOCUMENTS

| | | | | |
|---|---|---|---|---|
| CN | 205203523 | U | | 5/2016 |
| CN | 106314893 | A | * | 1/2017 |
| CN | 106516279 | A | | 3/2017 |
| EP | 0539100 | A1 | | 4/1993 |

* cited by examiner

CORE OF HIGH-EFFICIENCY AND HIGH-SPEED CARTON SEALER AND METHOD FOR USING THE SAME

FIELD OF THE INVENTION

The invention belongs to the technical field of mechanical equipment, and relates to a core of a high-efficiency and high-speed or soft or empty carton sealer and a method for using the same.

BACKGROUND OF THE INVENTION

Cartons are the most widely used packaging products. Most of the modern mass-produced products are operated on an production line, and mechanical equipment is configured at each corresponding part of the production line, thereby reducing the labor intensity of workers and improving the production efficiency. Carton sealing equipment is often arranged at a back end of the production line to seal and pack the products for convenience in storage and transport. However, the carton sealing equipment manufactured currently is often prone to folds and automatic fall-off of tape, resulting in unpacking, which affects the shipment or even causes the shutdown of the subsequent unmanned automatic production line; the sealing speed is low; and there are more problems especially when tape has poor quality, cartons are soft and the products in cartons do not fill the cartons, which seriously affects the popularization of automation after sealing. For the above reasons, there is currently no core of high-efficiency and high-speed carton sealers, which directly limits the development of the high-efficiency and high-speed carton sealers.

The applicant of the invention has found that the root cause of the folds of the sealing tape of a carton sealer is the tension of tape, and the method for eliminating the folds is how to release the tension before cutting off the tape. What is described here is just a specific scheme, which solves the contradiction that a front arm wheel and a rear arm wheel of an original core of a carton sealer are linked but have different restoring forces under the action of a connecting rod, so that the front arm wheel does not damage a carton and the rear arm wheel can tightly fit the carton to normally apply the tape to a back side of the carton during high-speed sealing. In this way, a core of a high-efficiency and high-speed carton sealer has been successfully designed and manufactured, which is a prerequisite for the design and manufacture of a high-speed carton sealer.

The existing technical problems are two main contradictions. The first problem is about the viscosity of tape. In order to firmly seal a carton with tape, the greater the viscosity of the tape, the more firmly the carton is sealed. On the other hand, when the tape is applied to the carton, the greater the viscosity of the tape, the more tightly the tape is stretched when the tape is peeled off from a tape roll during sealing, and the greater the tension of the tape, so that the tape is easier to fold, and the tape head is easier to fall off by itself. If the viscosity of the tape is smaller, the tape is less firmly applied to the carton and also falls off more easily. At present, the manufacturers who use tape and the tape manufacturers constantly make adjustment according to the climate, cartons, substrates of tape, the customers' requirements and other factors, but the tape has poor effect, high cost and many problems. The second problem is the contradiction between the restoring forces of a front arm wheel and a rear arm wheel. From the perspective of carton sealing, the greater the restoring force of the rear arm wheel, the higher the return speed, and the more tightly the rear arm wheel is applied to a high-speed moving carton from its horizontal plane to its back side, so that tape is normally applied to the carton, but the greater the restoring force of a spring, the greater the impact force when the carton encounters the front arm wheel and the greater the pressure that forces the front arm wheel to withdraw, with the result that the carton is more liable to be deformed or even damaged, which limits the increase in sealing speed, and the problem of carton deformation or even damage is more serious when the carton is softer or not filled with products. Based on the above contradictions, the existing carton sealer can only take into account the two contradictions, which limits the increase in the speed of the carton sealer and the improvement of the sealing quality. In order to cope with the serious problems of folds and automatic fall-off of the sealing tape, the viscosity of the tape is often adjusted, or even the quality of the cartons and tape is improved, and the speed of the carton sealer is reduced, otherwise the problems will be more serious.

Therefore, in order to solve the above technical problems, it is necessary to improve and upgrade a core of a high-efficiency and high-speed carton sealer based on an original core of a carton sealer, which is a prerequisite for the design and manufacture of a high-efficiency and high-speed carton sealer, thus improving the efficiency of a production line and further developing production automation.

SUMMARY OF THE INVENTION

To overcome the problems existing in the background art, the invention provides a core of a high-efficiency and high-speed carton sealer, which includes a main fixing plate, a first cylinder, a return spring, a spring, a front arm, a rear arm, a connecting rod and a second cylinder, wherein a tape roll fixing core seat is fixed on an upper part of the main fixing plate, a tension-variable mechanism bracket is fixed in the middle of the main fixing plate, a front arm shaft and a rear arm shaft are fixed at a lower part of the main fixing plate, a one-way knurled wheel and a first tape guide wheel are fixed on the main fixing plate, the first cylinder is fixed on the tension-variable mechanism bracket, a pre-stretching roller is fixed at a top end of an piston rod of the first cylinder, the tension-variable mechanism bracket is provided with a guide rod corresponding to the pre-stretching roller, the front arm can rotate around the front arm shaft, the rear aim can rotate around the rear aim shaft, one end of the connecting rod is rotatably connected to the front arm through a first connecting rod shaft, the other end of the connecting rod is rotatably connected to the rear arm through a second connecting rod shaft, the front arm is provided with a front arm wheel and a second tape guide wheel, the rear arm is provided with a rear arm wheel, the bottom of the second cylinder is arranged on an elasticity-variable mechanism fixing shaft which is fixed on the main fixing plate, the second cylinder can rotate around the elasticity-variable mechanism fixing shaft, a spring stretching plate is fixed at a top end of an piston rod of the second cylinder, two return springs are fixed on the spring stretching plate, the other ends of the return spring are fixed on spring fixing plates of the rear arm, a first rear arm limiting block and a second rear arm limiting block are fixed on the main fixing plate, the second rear arm limiting block is provided with a threaded rod, the spring is fixed at a top end of the threaded rod, a tape guide plate shaft and a tape finger-pressing member shaft are fixed on the front arm, the tape guide plate shaft is provided with a tape guide plate, and the tape finger-pressing member shaft is provided with a tape finger-pressing member.

Preferably, the front arm wheel and the rear arm wheel are made of rubber and plastic materials.

A method for using the core of a high-efficiency and high-speed carton sealer comprises the following steps:

(1) when a carton to be sealed quickly enters a core area of the high-speed carton sealer and approaches the front arm wheel of the core, the first cylinder and the second cylinder are in a deflated state, the front arm wheel made of rubber and plastic materials contacts a front side of the carton to be sealed; and since the second cylinder is in a deflated state and the return springs are in a relaxed state, tape can be normally applied to the front side of the high-speed moving carton to be sealed, the tape previously stretched out by the first cylinder via the pre-stretching roller is used, and the tape has been firmly applied to the front side of the carton to be sealed before being tightened;

(2) then the core of the high-speed carton sealer seals an upper or lower side of the carton to be sealed; after the tape previously stretched out by the pre-stretching roller is used up, tape on a tape roll is used; at this time, since a front end of the tape has been fixed on the front side of the carton to be sealed, the tape can also continue to be pulled down quickly from the tape roll even if the carton is moved fast, thereby ensuring that the core of the high-speed carton sealer can quickly seal the upper or lower side of the carton to be sealed;

(3) before the upper or lower side of the carton to be sealed is completely sealed, the second cylinder and the first cylinder are inflated separately, wherein the inflation of the second cylinder allows the return springs to be stretched, which increases the restoring force to the rear arm wheel; and the inflation of the first cylinder allows the pre-stretching roller to be pushed out, the tape can only be pulled out from the tape roll due to the presence of the one-way knurled wheel so as to complete the pre-stretching of the tape, the first cylinder is deflated before a blade cuts off the tape to release the tension of the tape, the remaining tension of the tape is effectively controlled by controlling the deflation of the first cylinder, and then the blade cuts off the tape; and (4) after the tape is cut off, a back side of the carton to be sealed is sealed, then the tape is flat to be rolled by the rear arm wheel, then the return speed of the rear arm wheel is increased under the restoring force of the return springs and the auxiliary action of the spring on the second rear arm wheel limiting block, the rear arm wheel can tightly fit the surface of the carton for quick sealing when reaching the back side of the carton to complete quick sealing of the carton, the remaining part of the pre-stretched tape is to be used for sealing a front side of the next carton after this carton is sealed, and then the second cylinder is deflated to complete the entire sealing process of the carton.

Preferably, the inflation of the first cylinder and the second cylinder is controlled by a solenoid valve, the pull-in of which is controlled by a sensor.

The core of the high-efficiency and high-speed carton sealer designed by the invention enables high-quality and quick sealing of front and back sides of a carton to be sealed, and can also seal upper and lower sides of the carton, thus effectively improving the sealing speed, lowering the quality requirements on tape and cartons, reducing the defective rate of sealing and comprehensively improving the economic benefit. The core of the high-efficiency and high-speed carton sealer is scientific and reasonable in structure, unique in concept, and convenient and reliable to use, can be applied in a wide range and is suitable for popularization.

BRIEF DESCRIPTION OF THE DRAWINGS

The invention will be further described with reference to the drawings and embodiments.

In the Figures, 1. main fixing plate; 2. tape roll fixing core seat; 3. tension-variable mechanism bracket; 4. first cylinder; 5. pre-stretching roller; 6. guide rod; 7. one-way knurled wheel; 8. elasticity-variable mechanism fixing shaft; 9. second cylinder; 10. spring stretching plate; 11. second connecting rod shaft; 12. return spring; 13. spring; 14. spring fixing plate; 15. front arm; 16. rear arm; 17. connecting rod; 18. first connecting rod shaft; 19. front arm shaft; 20. rear arm shaft; 21. front arm wheel; 22. rear arm wheel; 23. first rear arm limiting block; 24. second rear arm limiting block; 25. first tape guide wheel; 26. second tape guide wheel; 27. tape guide plate; 28. tape guide plate shaft; 29. tape finger-pressing member; 30. tape finger-pressing member shaft; 31. threaded rod.

DETAILED DESCRIPTION OF THE INVENTION

The invention will be further described in detail with reference to the drawings. The drawings are simplified schematic views, which only illustrate the basic structure of the invention in a schematic manner, and therefore only show the configuration related to the invention.

Figure 1:
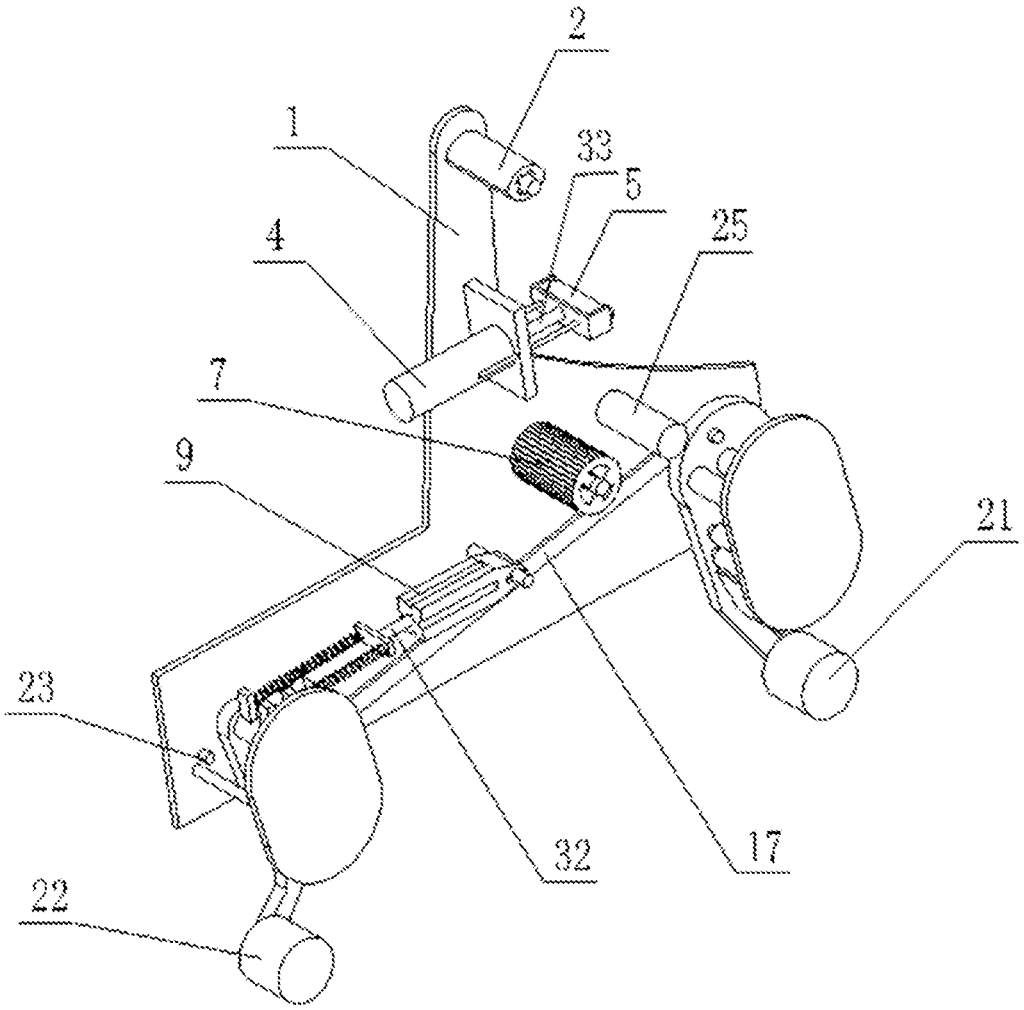
FIG. 1 is a schematic structural view of a core of a high-efficiency and high-speed carton sealer according to the invention.
Figure 2:
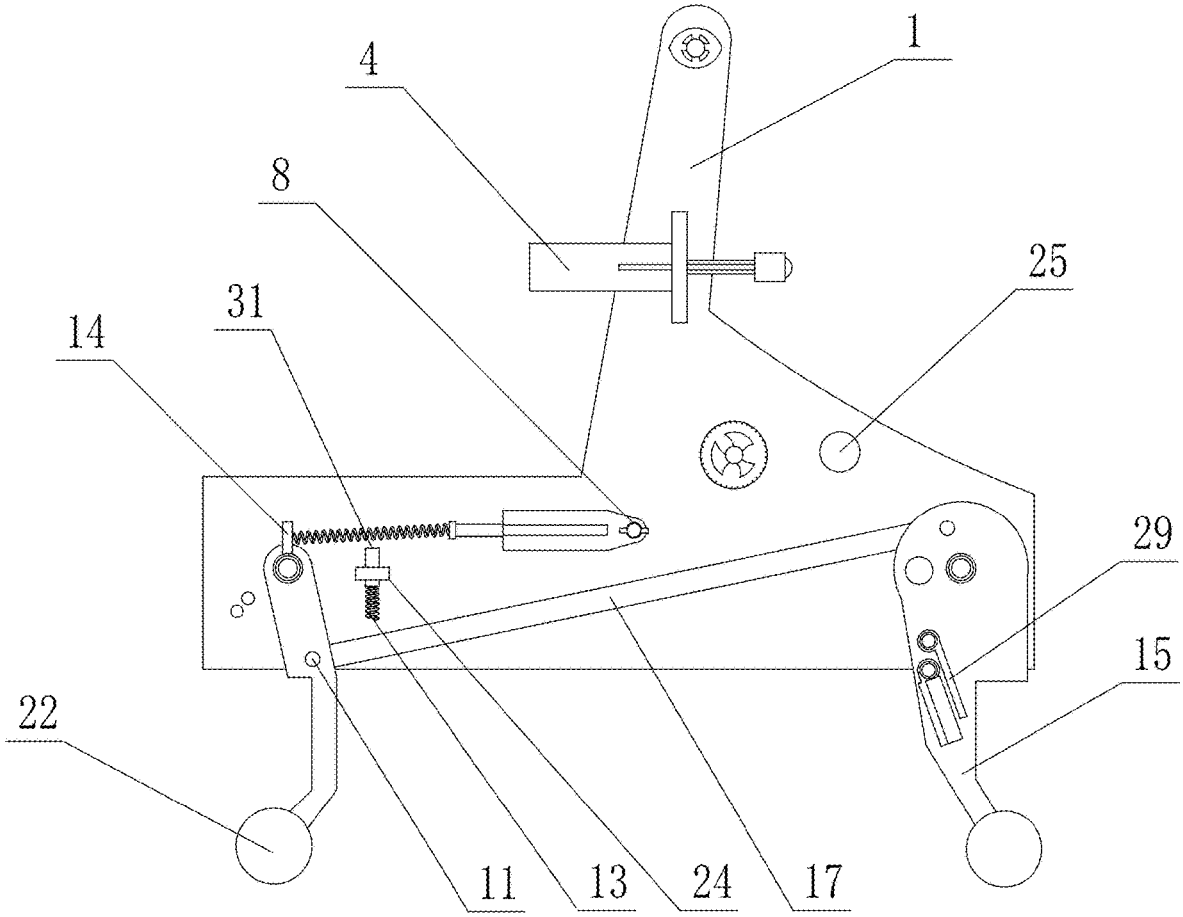
FIG. 2 is a first schematic view of the internal structure of the core of the high-efficiency and high-speed carton sealer according to the invention.
Figure 3:
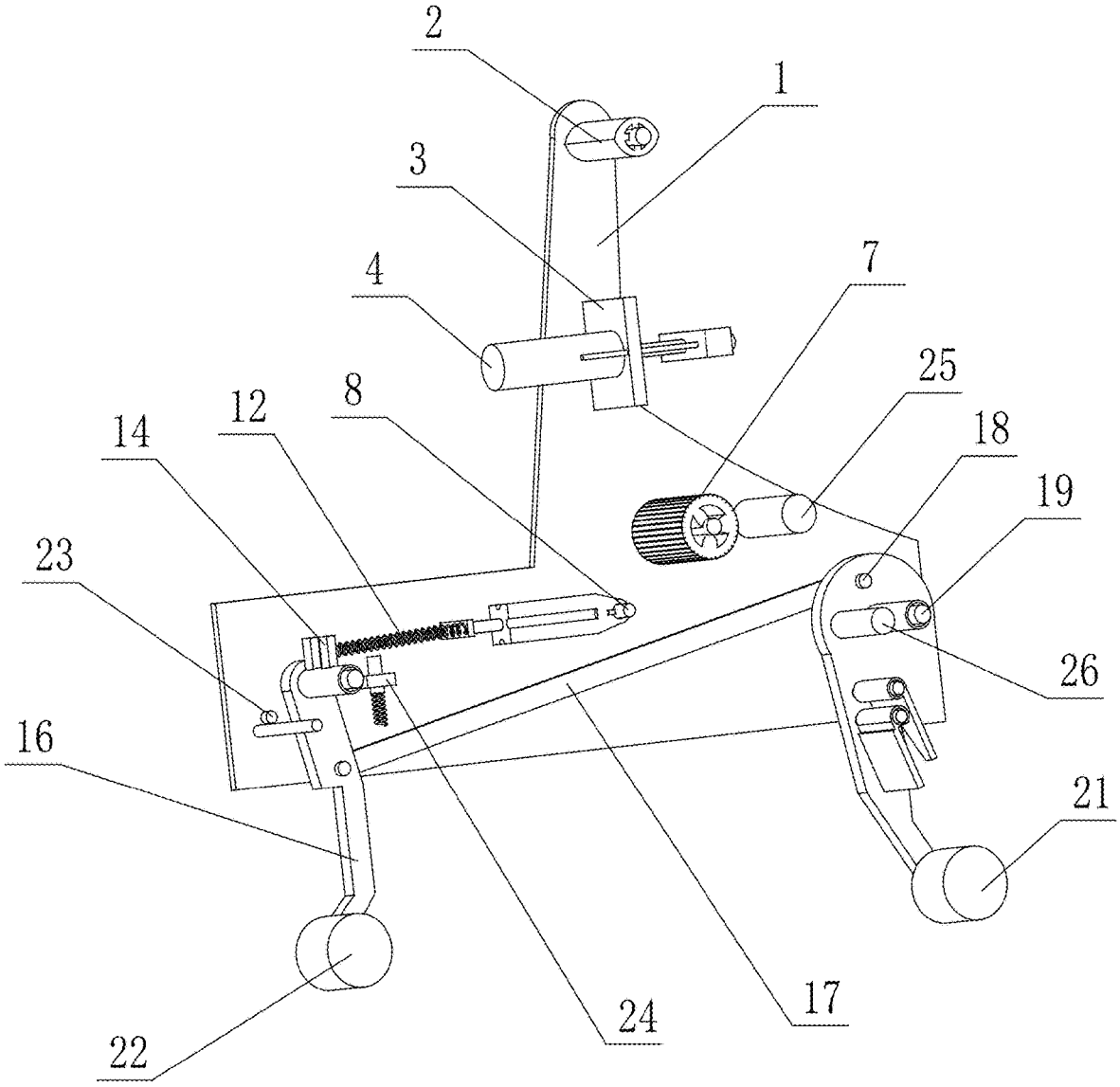
FIG. 3 is a second schematic view of the internal structure of the core of the high-efficiency and high-speed carton sealer according to the invention.
Figure 4:
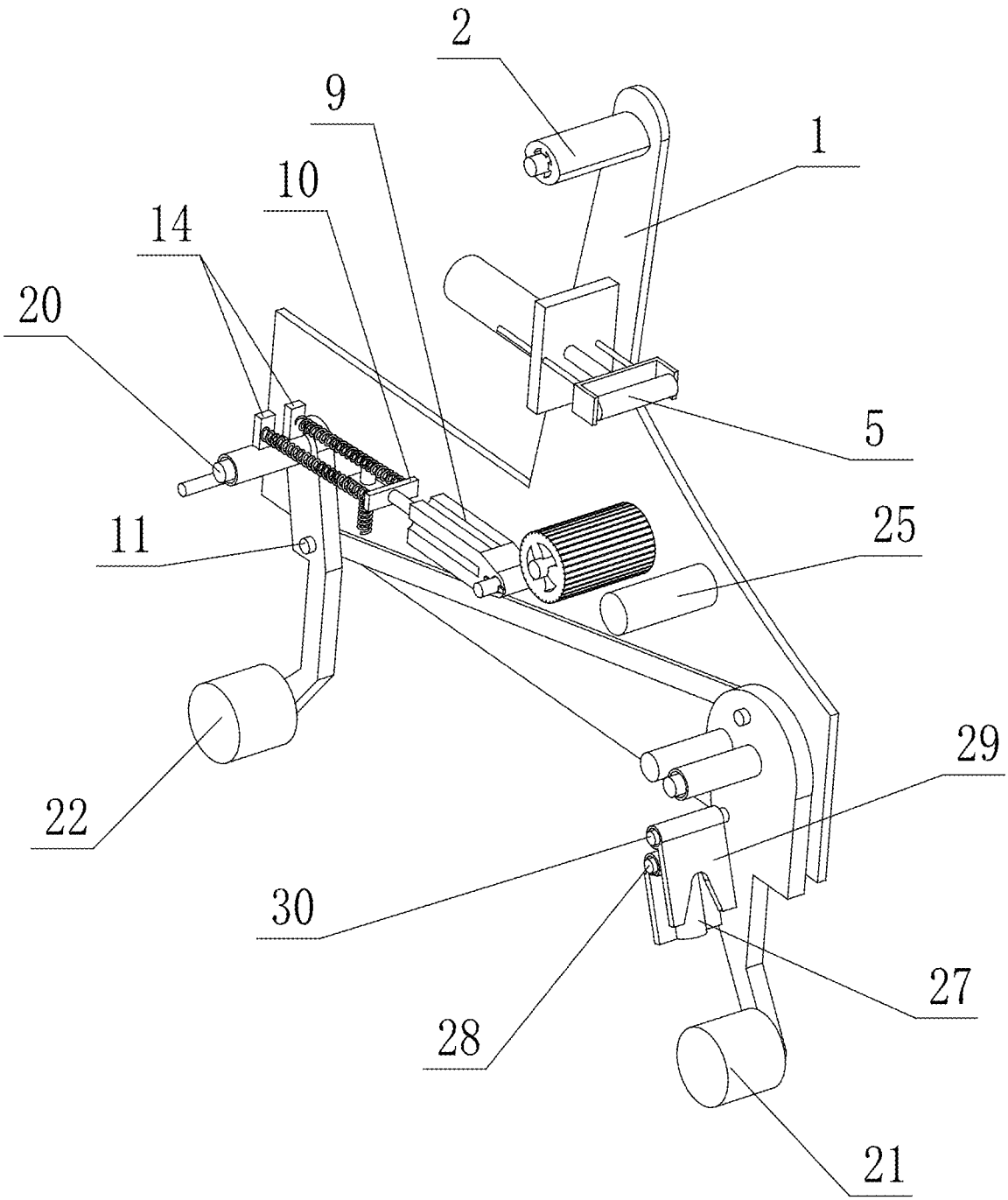
FIG. 4 is a third schematic view of the internal structure of the core of the high-efficiency and high-speed carton sealer according to the invention.
Figure 5:
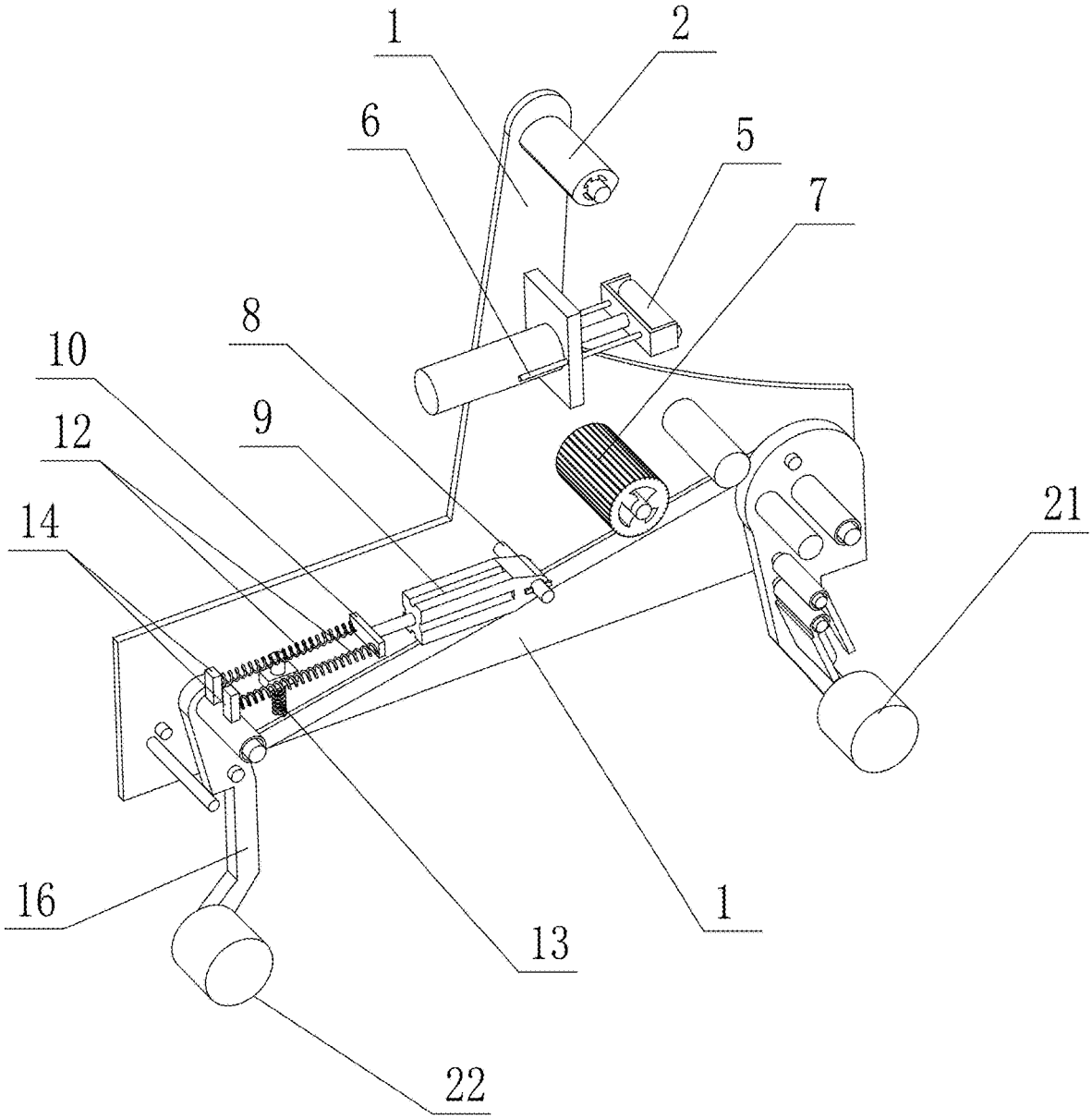
FIG. 5 is a fourth schematic view of the internal structure of the core of the high-efficiency and high-speed carton sealer according to the invention.

Referring to FIGS. 1 to 5 for Particular Embodiment 1, a core of a high-efficiency and high-speed carton sealer includes a main fixing plate 1, a first cylinder 4, a return spring 12, a spring 13, a front arm 15, a rear aim 16, a connecting rod 17 and a second cylinder 9, wherein a tape roll fixing core seat 2 is fixed on an upper part of the main fixing plate 1, a tension-variable mechanism bracket 3 is fixed in the middle of the main fixing plate 1, a front arm shaft 19 and a rear arm shaft 20 are fixed at a lower part of the main fixing plate 1, a one-way knurled wheel 7 and a first tape guide wheel 25 are fixed on the main fixing plate 1, the first cylinder 4 is fixed on the tension-variable mechanism bracket 3, a pre-stretching roller 5 is fixed at a top end of an piston rod 33 of the first cylinder 4, the tension-variable mechanism bracket 3 is provided with a guide rod 6 corresponding to the pre-stretching roller 5, the front arm 15 can rotate around the front arm shaft 19, the rear arm 16 can rotate around the rear arm shaft 20, one end of the connecting rod 17 is rotatably connected to the front arm 15 through a first connecting rod shaft 18, the other end of the connecting rod 17 is rotatably connected to the rear arm 16 through a second connecting rod shaft 11, the front arm 15 is provided with a front arm wheel 21 and a second tape guide wheel 26, the rear arm 16 is provided with a rear arm wheel 22, the bottom of the second cylinder 9 is arranged on an elasticity-variable mechanism fixing shaft 8 which is fixed on the main fixing plate 1, the second cylinder 9 can rotate around the elasticity-variable mechanism fixing shaft 8, a spring stretching plate 10 is fixed at a top end of an piston rod 32 of the second cylinder 9, two return springs 12 are fixed on the spring stretching plate 10, the other ends of the return springs 12 are fixed on spring fixing plates 14 of the rear arm 16, a first rear arm limiting block 23 and a second rear arm limiting block 24 are fixed on the main fixing plate 1, the second rear arm limiting block 24 is provided with a threaded rod 31, the spring 13 is fixed at a top end of the threaded rod 31, a tape guide plate shaft 28 and a tape finger-pressing member shaft 30 are fixed on the front arm 15, the tape guide plate shaft 28 is provided with a tape guide plate 27, and the tape finger-pressing member shaft 30 is provided with a tape finger-pressing member 29.

The front arm wheel 21 and the rear arm wheel 22 are made of rubber and plastic materials.

A method for using the core of a high-efficiency and high-speed carton sealer comprises the following steps:

(1) when a carton to be sealed quickly enters a core area of the high-speed carton sealer and approaches the front arm wheel 21 of the core, the first cylinder 4 and the second cylinder 9 are in a deflated state, the front arm wheel 21 made of rubber and plastic materials contacts a front side of the carton to be sealed; and since the second cylinder 9 is in a deflated state and the return springs 12 are in a relaxed state, tape can be normally applied to the front side of the high-speed moving carton to be sealed, the tape previously stretched out by the first cylinder 4 via the pre-stretching roller 5 is used, and the tape has been firmly applied to the front side of the carton to be sealed before being tightened;

(2) then the core of the high-speed carton sealer seals an upper or lower side of the carton to be sealed; after the tape previously stretched out by the pre-stretching roller 5 is used up, tape on a tape roll is used; at this time, since a front end of the tape has been fixed on the front side of the carton to be sealed, the tape can also continue to be pulled down quickly from the tape roll even if the carton is moved fast, thereby ensuring that the core of the high-speed carton sealer can quickly seal the upper or lower side of the carton to be sealed;

(3) before the upper or lower side of the carton to be sealed is completely sealed, the second cylinder 9 and the first cylinder 4 are inflated separately, wherein the inflation of the second cylinder 9 allows the return springs 12 to be stretched, which increases the restoring force to the rear arm wheel; and the inflation of the first cylinder 4 allows the pre-stretching roller 5 to be pushed out, the tape can only be pulled out from the tape roll due to the presence of the one-way knurled wheel 7 so as to complete the pre-stretching of the tape, the first cylinder 4 is deflated before a blade cuts off the tape to release the tension of the tape, the remaining tension of the tape is effectively controlled by controlling the deflation of the first cylinder 4, and then the blade cuts off the tape; and (4) after the tape is cut off, a back side of the carton to be sealed is sealed, then the tape is flat to be rolled by the rear arm wheel 22, then the return speed of the rear arm wheel 22 is increased under the restoring force of the return springs 12 and the auxiliary action of the spring 13 on the second rear arm wheel limiting block 24, the rear arm wheel 22 can tightly fit the surface of the carton for quick sealing when reaching the back side of the carton to complete quick sealing of the carton, the remaining part of the pre-stretched tape is to be used for sealing a front side of the next carton after this carton is sealed, and then the second cylinder 9 is deflated to complete the entire sealing process of the carton.

The inflation of the first cylinder 4 and the second cylinder 9 is controlled by a solenoid valve, the pull-in of which is controlled by a sensor.

The core of a high-efficiency and high-speed carton sealer designed by the invention enables high-quality and quick sealing of front and back sides of a carton to be sealed, and can also seal upper and lower sides of the carton, thus effectively improving the sealing speed, lowering the quality requirements on tape and cartons, reducing the defective rate of sealing and comprehensively improving the economic benefit. The core of a high-efficiency and high-speed carton sealer is scientific and reasonable in structure, unique in concept, and convenient and reliable to use, can be applied in a wide range and is suitable for popularization.

It is apparent that the above embodiment is merely an example for clear description and not intended to limit the embodiments. Those of ordinary skill in the art can also make other different forms of changes or alternations based on the above description. There is no need and no way to exhaustively list all the embodiments. Obvious changes or alternations derived therefrom still fall within the protection scope of the invention.

The invention claimed is:

1. A core of a high-efficiency and high-speed carton sealer, comprising:

a main fixing plate;

a first cylinder;

a return spring;

a spring;

a front arm;

a rear arm;

a connecting rod; and a second cylinder, wherein a tape roll fixing core seat is fixed on an upper part of the main fixing plate, a tension-variable mechanism bracket is fixed in the middle of the main fixing plate, a front arm shaft and a rear arm shaft are fixed at a lower part of the main fixing plate, a one-way knurled wheel and a first tape guide wheel are fixed on the main fixing plate, the first cylinder is fixed on the tension-variable mechanism bracket, a pre-stretching roller is fixed at a top end of a piston rod of the first cylinder, the tension-variable mechanism bracket is provided with a guide rod corresponding to the pre-stretching roller, the front arm can rotate around the front arm shaft, the rear arm can rotate around the rear arm shaft, one end of the connecting rod is rotatably connected to the front arm through a first connecting rod shaft, the other end of the connecting rod is rotatably connected to the rear arm through a second connecting rod shaft, the front arm is provided with a front arm wheel and a second tape guide wheel, the rear arm is provided with a rear arm wheel, the bottom of the second cylinder is arranged on an elasticity-variable mechanism fixing shaft which is fixed on the main fixing plate, the second cylinder can rotate around the elasticity-variable mechanism fixing shaft, a spring stretching plate is fixed at a top end of a piston rod of the second cylinder, two return springs are fixed on the spring stretching plate, the other ends of the return springs are fixed on spring fixing plates of the rear arm, a first rear arm limiting block and a second rear arm limiting block are fixed on the main fixing plate, the second rear arm limiting block is provided with a threaded rod, the spring is fixed at a top end of the threaded rod, a tape guide plate shaft and a tape finger-pressing member shaft are fixed on the front arm, the tape guide plate shaft is provided with a tape guide plate, and the tape finger-pressing member shaft is provided with a tape finger-pressing member.

2. The core of a high-efficiency and high-speed carton sealer according to claim 1, wherein the front arm wheel and the rear arm wheel are made of rubber and plastic materials.

3. A method for using the core of a high-efficiency and high-speed carton sealer according to claim 1, comprising the following steps:

when a carton to be sealed quickly enters a core area of the high-speed carton sealer and approaches the front arm wheel of the core, the first cylinder and the second cylinder are in a deflated state, the front arm wheel made of rubber and plastic materials contacts a front side of the carton to be sealed; and since the second cylinder is in a deflated state and the return springs are in a relaxed state, tape can be normally applied to the front side of the high-speed moving carton to be sealed, the tape previously stretched out by the first cylinder via the pre-stretching roller is used, and the tape has been firmly applied to the front side of the carton to be sealed before being tightened;

(2) then the core of the high-speed carton sealer seals an upper or lower side of the carton to be sealed; after the tape previously stretched out by the pre-stretching roller is used up, tape on a tape roll is used; at this time, since a front end of the tape has been fixed on the front side of the carton to be sealed, the tape can also continue to be pulled down quickly from the tape roll even if the carton is moved fast, thereby ensuring that the core of the high-speed carton sealer can quickly seal the upper or lower side of the carton to be sealed;

(3) before the upper or lower side of the carton to be sealed is completely sealed, the second cylinder and the first cylinder are inflated separately, wherein the inflation of the second cylinder allows the return springs to be stretched, which increases the restoring force to the rear arm wheel; and the inflation of the first cylinder allows the pre-stretching roller to be pushed out, the tape can only be pulled out from the tape roll due to the presence of the one-way knurled wheel so as to complete the pre-stretching of the tape, the first cylinder is deflated before a blade cuts off the tape to release the tension of the tape, the remaining tension of the tape is effectively controlled by controlling the deflation of the first cylinder, and then the blade cuts off the tape; and (4) after the tape is cut off, a back side of the carton to be sealed is sealed, then the tape is flat to be rolled by the rear arm wheel, then the return speed of the rear arm wheel is increased under the restoring force of the return springs and the auxiliary action of the spring on the second rear arm wheel limiting block, the rear arm wheel can tightly fit the surface of the carton for quick sealing when reaching the back side of the carton to complete quick sealing of the carton, the remaining part of the pre-stretched tape is to be used for sealing a front side of the next carton after this carton is sealed, and then the second cylinder is deflated to complete the entire sealing process of the carton.

4. A method for using the core of a high-efficiency and high-speed carton sealer according to claim 3, wherein the inflation of the first cylinder and the second cylinder is controlled by a solenoid valve, the pull-in of which is controlled by a sensor.

* * * * *